United States Patent [19]

Carrigan

[11] Patent Number: 4,660,834

[45] Date of Patent: Apr. 28, 1987

[54] SHORT GOLF COURSE AND GOLF BALL

[76] Inventor: Andrew J. Carrigan, 19022 SE. 62nd Pl., Issaquah, Wash. 98027

[21] Appl. No.: 817,895

[22] Filed: Jan. 13, 1986

[51] Int. Cl.[4] ..... A63B 69/36; A63B 41/00

[52] U.S. Cl. ..... 273/176 AB; 273/199 R; 273/219; 273/232; 273/60 B; 273/58 B; 273/218

[58] Field of Search ..... 273/199 R, 193 R, 218, 273/65 D, 176 AB, 219, 232, 230, 220, 199 A, 58 B, 58 BA, 60 B

[56] References Cited

U.S. PATENT DOCUMENTS

| | | | |
|---|---|---|---|
| 2,624,072 | 1/1953 | Delacoste et al. | 18/58.3 |
| 2,681,472 | 6/1954 | Rempel | 18/26 |
| 3,040,384 | 6/1962 | Whittington | 273/65 D |
| 3,072,965 | 1/1963 | Miller | 18/26 |
| 3,427,030 | 2/1969 | Ward | 273/199 R |
| 3,515,389 | 6/1970 | Wolfe | 273/193 R |
| 3,940,145 | 2/1976 | Gentiluomo | 273/232 X |
| 3,999,764 | 12/1976 | Nitsche | 273/176 AB |
| 4,026,561 | 5/1977 | Baldorossi et al. | 273/193 R |
| 4,150,826 | 4/1979 | Baldorossi et al. | 273/218 |
| 4,256,304 | 3/1981 | Smith et al. | 273/232 X |

FOREIGN PATENT DOCUMENTS 17132 of 1905 United Kingdom ..... 273/230

OTHER PUBLICATIONS

"Rotational Molding" by Richard E. Duncan et al, *Encyclopedia of Polymer Science and Technology,* vol. 9, pp. 118–137 (1968).

"Rotational Casting" by C. A. Brighton, *Encyclopedia of Polymer Science and Technology,* vol. 14, pp. 450–451 (1971).

"Polyvinyl and Vinyl Copolymers" by G. F. Cohan, *Modern Plastics Encyclopedia* 1979–1980, pp. 102–111.

"Polyvinyl and Vinyl Copolymers" by R. J. Jeziorski et al, *Modern Plastics Encyclopedia* 1984–1985, pp. 90–94.

"Cougar Mountain Big Ball Course Official Scorecard" (copyright 1983).

"Third Annual ABC Messenger Big Ball Tournament Official Score Card" (Jul. 16, 1983).

*Primary Examiner*—George J. Marlo

*Attorney, Agent, or Firm*—John O. Graybeal

[57] ABSTRACT

The combination of (a) a multi-hole short golf course, playable with conventional golf clubs, with the length of the holes from tee to green varying from about 60 yards to about 195 yards and with a cup on each green having a diameter of about 8 to 10 inches; and (b) an oversize hollow inflated golf ball with which the short golf course is played. The golf ball comprises: a durable spherical plastic ball having an inflated diameter of 3.0 to 4.0 inches, a wall thickness of 0.170 to 0.220 inch, a weight of 90 to 100 grams, and an air pressurization of 8 to 10 pounds per square inch. The ball has 8 to 10 dimples per square inch in its exterior surface, each of the dimples having a depth of 0.018 to 0.022 inch and a diameter of 0.250 to 0.310 inch. The ball wall is constructed of vinyl polymer, or vinyl copolymer, containing a plasticizer. The ball wall has a hardness of about Shore A 70 Durometer. The ball has an aperture for receiving air under pressure. The aperture is sealed by a resilient plug inserted therein, whereby the air pressurization is maintained within the inflated ball.

5 Claims, 3 Drawing Figures

SHORT GOLF COURSE AND GOLF BALL

BACKGROUND OF THE INVENTION (1) Field Of The Invention

This invention relates to a game of golf which is played on a course which is shorter than conventional golf courses. A special oversize hollow inflated golf ball and conventional golf clubs are used in the play of the game.

(2) Description Of The Prior Art

The following representative patents illustrate the state of the art prior to the present invention. Ward U.S. Pat. No. 3,427,030 discloses a miniature golf course the play of which involves two different types of balls, a conventional size solid plastic ball for putting and a conventional size open hollow ball for driving and chipping. The fairways are terminated by a tee and a green spaced apart by approximately 65 feet of gravel-covered expanse. Brush mats are affixed to the expanse for intermediate golf shots. The green is between 100 and 200 square feet in area and includes a hole defined in a continuous turf-like surface.

Wolfe U.S. Pat. No. 3,515,389 describes a golf club head and ball, both made of high energy absorbing butyl rubber, for playing miniature golf. The club head is connected to the club shaft by an integral stem which permits the head to flex relative to the stem section upon ball impact and thereby adds to the energy absorbing characteristics of the butyl rubber. The club head includes a plurality of different lofted striking faces, one of which is detachable.

Nitsche U.S. Pat. No. 3,999,764 describes a golf course which is laid out around a central core with the individual golf holes extending radially from the core. The core comprises a plurality of substantially rigid vertical panels, topped by panels of wire mesh. Mirror images of the holes are drawn or displayed on the vertical panels and traps and water hazards on the panels are provided with a plurality of pins or spikes extending therefrom. The putting cup image on the panel may take the form of an aperture permitting a hole-in-one to be scored. A lightweight apertured practice ball is used to tee off and is driven against the vertical panel whereby it rebounds onto the grass at which time a regular ball is substituted for chipping and putting. If the practice ball strikes a hazard on the panel, it is held by the spikes and penalty shots can be taken. This arrangement allows a golf course to be laid out in a relatively small area.

Baldorossi et al U.S. Pat. No. 4,026,561 describes a golf game playable in an area approximately 1/15th of the area of a regulation golf course with the length of play being approximately 1/5th the length of a regulation 18-hole golf course. The game employs a large golf ball and a set of golfing clubs having heads of large size. The ball has a small weight-to-volume ratio in that it weighs approximately 2 ounces and is approximately 5 inches in diameter, and is typically of lightweight foam construction. Each of the clubs has a head having a weight very similar to that of a regulation golf club and a face inclined at approximately the angle of the corresponding regulation golf club. Each of the faces has a surface area approximately 2.8 times larger than the faces of regulation golf clubs, with the relationship between the ball and each of the clubs being such as to permit a form of play action like the play action of regulation golf in that a player will be able to utilize an unrestricted swing in hitting the ball and in obtaining a feel which is similar to that received when he swings a regulation golf club and hits a regulation golf ball. The ball in this instance travels for a comparatively short distance because of its small weight-to-volume ratio.

Baldorossi et al U.S. Pat. No. 4,150,826 discloses a soft golf ball having a diameter of 4.2 to 5.0 inches and a weight of 2.0 to 2.5 ounces (56.7 to 70.7 grams), with an interior portion of closed cell flexible foam of a density of 2 to 4 lbs. per cubic foot, molded with a thick integrally formed skin or alternatively equipped with a thick skin applied as a coating.

SUMMARY OF THE INVENTION

One aspect of the present invention is the combination of:

(a) a multi-hole short golf course, playable with conventional regulation golf clubs, with the length of the holes from tee to green varying from about 60 yards to about 195 yards and with a cup on each green having a diameter of about 8 to 10 inches, and (b) an oversize hollow inflated golf ball with which the short golf course if played, each of the golf balls comprising:

(1) a durable spherical hollow plastic ball having an inflated diameter of 3.0 to 4.0 inches, a wall thickness of 0.170 to 0.220 inch, a weight of 90 to 100 grams, and an internal air pressure of 8 to 10 pounds per square inch;

(2) a ball having 8 to 10 dimples per square inch in its exterior surface, with each of the dimples having a depth of 0.018 to 0.022 inch and a diameter of 0.250 to 0.310 inch;

(3) a ball wall of plasticized vinyl polymer or vinyl copolymer, the ball wall having a hardness of about Shore A 70 Durometer; and (4) a ball wall having an aperture for receiving air under pressure, the aperture being closed by a resilient plug inserted therein whereby the air pressurization is maintained within the inflated ball.

Another aspect of the present invention is the special oversize hollow golf ball per se designed to be used in playing the short course game of golf. The special golf ball has the physical and chemical characteristics described above.

DESCRIPTION OF THE PREFERRED EMBODIMENTS

The Special Oversize Hollow Golf Ball

Figure 1:
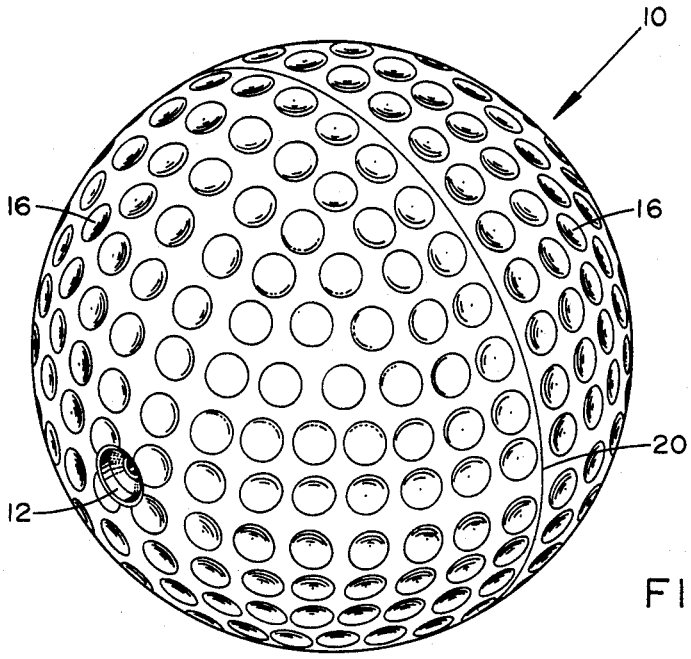
FIG. 1 is an isometric view of an oversize hollow inflated golf ball according to the present invention.

Referring to the drawings, FIG. 1 shows an oversize hollow inflated golf ball 10 embodying the invention. Golf ball 10 has a conventional aperture 12 for needle application of air under pressure. Aperture 12 is closed by a conventional resilient sealing plug 14, shown in FIG. 2, whereby the air pressure is maintained within the inflated ball 10. Ball 10 has numerous dimples 16 in the exterior surface 12 of wall 18.

Ball 10 can be manufactured by a conventional process using rotational casting of plastisols which leaves a slight seam 20 extending circumferentially around ball 10.

Figure 2:
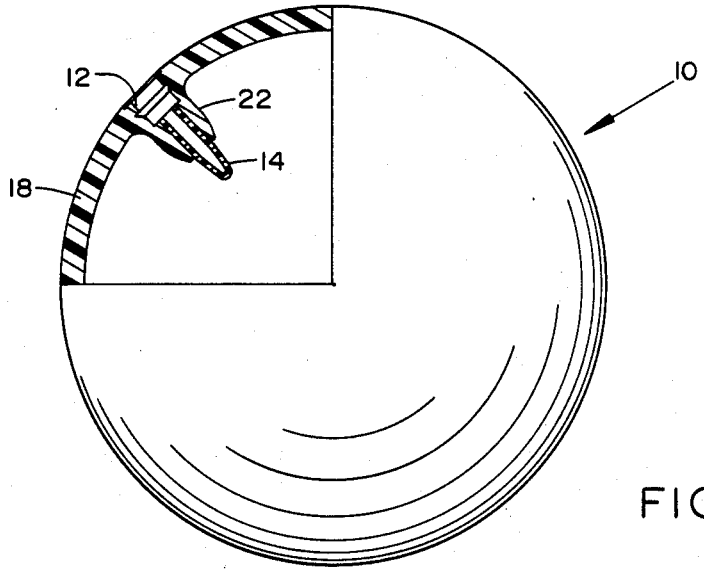
FIG. 2 is a side elevational view of the ball of FIG. 1 in a deflated state with a portion of the ball shown in vertical section to show the sealing plug inserted in the aperture in the wall of the ball. The remaining portion of the ball is shown schematically without the dimples shown in FIG. 1.

As shown in FIG. 2, extending inwardly from the aperture 12 of the ball 10 is a molded nipple 22 which is sealed by plug 14.

The physical and chemical characteristics of the golf ball 10 are as follows. Ball 10 is made of a durable polymeric plastic material. It has an inflated diameter of 3.0 to 4.0 inches. The deflated diameter is 2.5 to 3.5 inches. Ball 10 has a wall thickness of 0.170 to 0.220 inch and a weight of 90 to 100 grams. The air pressure inside ball 10 is 8 to 10 pounds per square inch.

The dimples 16 in the exterior surface of wall 18 are sufficiently numerous to have 8 to 10 dimples per square inch. Each of the dimples 16 has a depth of 0.018 to 0.022 inch and a diameter of 0.250 to 0.310 inch.

The ball 10 is preferably constructed of a vinyl polymer or copolymer, containing a plasticizer. The vinyl family of polymers and copolymers are described in the two *Modern Plastics Encyclopedia* articles, cited below. The ball wall 18 preferably has a hardness of about Shore A 70 Durometer. The ball can be any desired color, such as white, yellow, red, or blue.

The vinyl polymers, of which polyvinyl chloride (PVC) is the leading example, comprise a family of resins based on the monomers vinyl chloride ($CH_2{=}CHCl$), vinyl acetate ($CH_2{=}CHOCOCH_3$), and vinylidene chloride ($CH_2{=}CCl_2$). In addition, the family includes copolymers of PVC, chlorinated PVC, polyvinyl alcohol, polyvinyl butyral, and polyvinylidene fluoride.

Polyvinyl chloride is a suitable thermoplastic for the ball because it is:

(1) Chemically inert. The ball 10 made of PVC is resistant to corrosion from water, acids, and alkalies; it is resistant to oxidation; it has good outdoor weathering properties; and it is sufficiently stable so that its properties are maintained over long periods of time.

(2) Versatile. The ball 10 made of PVC has a high strength-to-weight ratio.

(3) Inexpensive. Capable of providing these properties at an economical cost.

EXAMPLE 1

A typical example of ball 10 is one with an inflated diameter of about 3.25 inches, a wall thickness of about 0.2 inch, a weight of about 95 grams, an air pressurization of about 9 pounds per square inch, and about 9 dimples per square inch in its exterior wall surface, each of the dimples having a depth of about 0.020 inch and a diameter of about 0.280 inch.

Rotational casting (also referred to as rotational molding) is described in Whittington U.S. Pat. No. 3,040,384, Miller U.S. Pat. No. 3,072,965, Delacoste et al U.S. Pat. No. 2,624,072, Rempel U.S. Pat. No. 2,681,472, in the article "Rotational Molding" by Richard E. Duncan et al in *Encyclopedia Of Polymer Science And Technology,* vol. 9, pages 118–137 (1968), in the article "Rotational Casting" by C. A. Brighton in *Encyclopedia Of Polymer Science And Technology,* vol. 14, pages 450–451 (1971), in the article "Polyvinyl And Vinyl Copolymers" by G. F. Cohan in *Modern Plastics Encyclopedia* 1979–1980, pages 102–111, at page 111, and in the article "Polyvinyl And Vinyl Copolymers" by R. J. Jeziorski et al in *Modern Plastics Encyclopedia* 1984–1985, pages 90–94, at page 93. The disclosures of the foregoing patents and articles are incorporated herein by reference. The ball may be suitably fabricated, for example, by the indicated rotational casting technique according to the following typical formula and to have a hardness of about Shore A 70 Durometer at ambient temperature. TYPICAL FORMULA:

| TYPICAL FORMULA: | | |
|---|---|---|
| 1. Resin | 100 parts by weight | "GEON 121" (PVC homopolymer) made by B. F. Goodrich Chemical Co. |
| 2. Plasticizer | 70 parts | Dioctyl phthalate |
| 3. Epoxy Stabilizer | 5 parts | "DRAPEX 6.8" (epoxidized soybean oil) made by Argus Chemical Corp. |
| 4. Heat Stabilizer and Wetting Agent | 3 parts | "MARK BB" liquid soap complex (organometallic salts based on tin, lead, barium, cadmium, calcium or zinc) made by Argus Chemical Corp. |
| 5. Filler | 20 parts | Calcium carbonate |
| 6. Pigment | 5 parts | Titanium dioxide |

Instead of a PVC homopolymer, the resin may be a vinyl copolymer (for faster fusion at lower temperatures).

The plasticizer may also be di-isooctyl phthalate, di-isodecyl phthalate, butylbenzyl phthalate, or dioctyl isophthalate. Low temperature plasticizers such as dioctyl sebacate and dioctyl azelate may also be used. A more resilient plasticizer which may be used is dioctyl adipate. There is a well-known direct relationship between the Shore A hardness of the product material and the parts of plasticizer per 100 parts of resin.

The epoxy stabilizer may also be "DRAPEX 3.2", "DRAPEX 4.4", or "DRAPEX 10.4", all made by Argus Chemical Corp. The number in the trademark refers to the oxygen bonding ability of the epoxidized soybean oil.

The filler may also be a finely ground silica such as "GOLD BOND R" made by Tammsco, Inc.

The pigment concentration will vary with the color strength, more pigment for yellow and less pigment with green and blue.

The Short Golf Course

Figure 3:
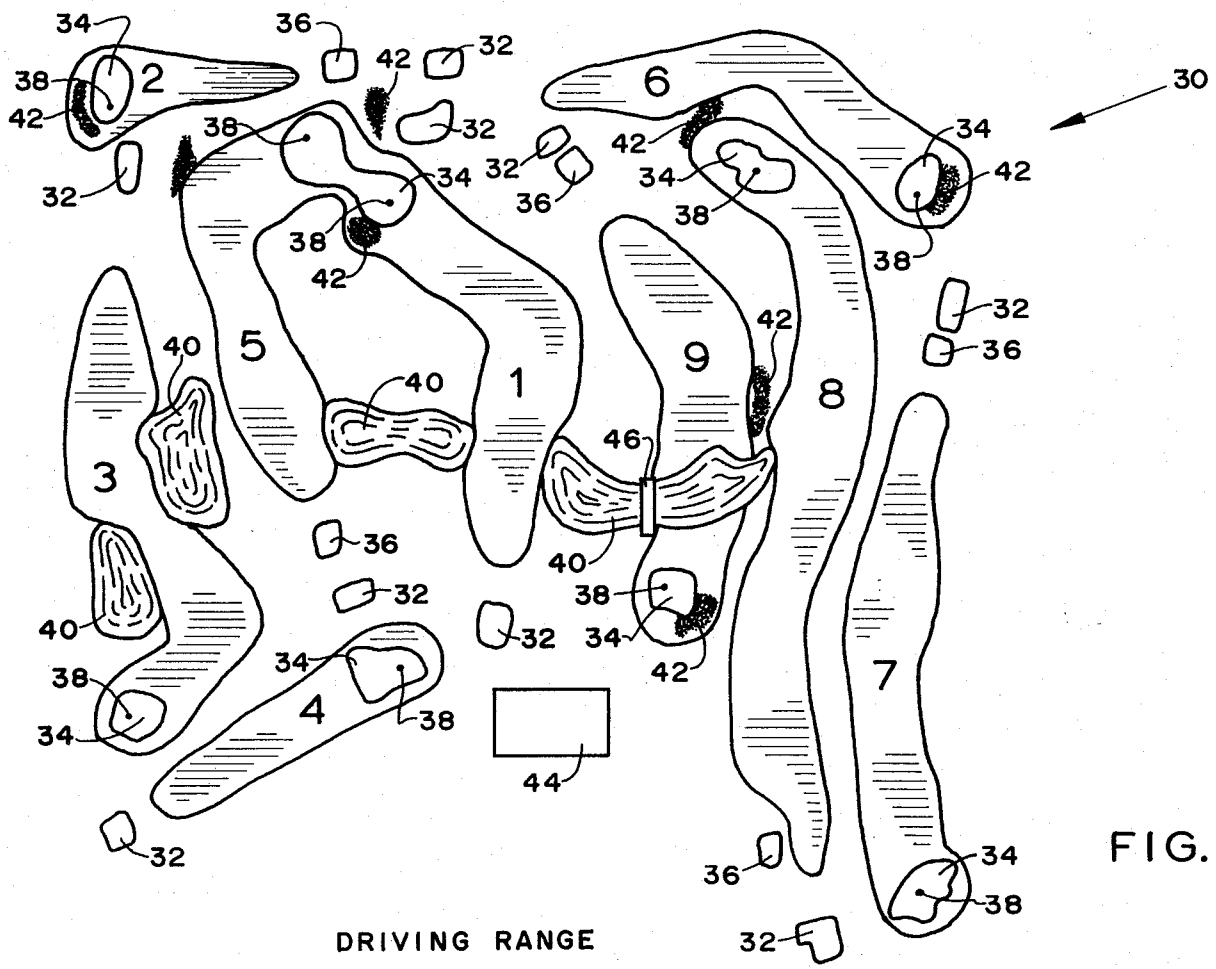
FIG. 3 is a schematic representation of a typical multi-hole short golf course constructed in accordance with the principles of the present invention.

The golf ball 10 is used in an outdoor game which resembles the regular game of golf in many ways, but which is played on a shortened golf course 30 as shown in FIG. 3. This short course golf game can be played by anyone of modest athletic ability from the age of six years old and older. Conventional regulation golf clubs are quite suitable to hit the golf ball 10 which is approximately twice the diameter of a regulation golf ball. As described above, the ball 10 has dimples proportionately similar to those of a regulation golf ball but with a substantial plastic wall 12 rather than being solid. Being filled with air under pressure, it has a firm feel when held in the hand but more "give" when hit with a club head than does a regulation ball. The weight of ball 10 is typically about 95 grams or about 50 grams more than a regulation golf ball, but the ball gives the impression of being a little lighter than a regulation golf ball because it is much less dense. Upon club contact with ball 10, however, the reaction on the golfer's arms and wrists feels very similar to that experienced when hitting a regulation golf ball with a conventional club.

Using ball 10, the game is played on a course 30 approximately one-third to one-half the length of a typical golf course, because the ball 10 cannot be hit as far as a regulation golf ball. A long drive in regulation golf might be about 260 to 270 yards. A long drive of ball 10 is about 100 to 110 yards. All of the clubs used in the regular game of golf are utilizeable in playing this game, including the pitching wedge and the putter. As in the conventional game of golf, in the short course game using this ball the larger the angle on the club face the higher will be the loft on a properly hit ball and the shorter will be the distance of the shot.

An average par three hole in this short course game suitably varies from a minimum of about 60 yards to a maximum of about 95 yards. A par four hole can be as short as about 100 yards and may be as long as about 170 yards. A par five hole can be as short as about 150 yards to a maximum length of approximately 195 yards.

As in the regular game of golf, each hole has a tee off area 32 and a green 34. Some holes also have a ladies tee off area 36 which is closer to the green. A player begins each hole at the tee off point 32 and after a series of approach shots reaches the green 34. Once on the green 34, the player uses a putter and completes the hole when the ball 10 is putted into an oversize cup 38 in the green. A suitable cup size is a cup about 8 to 10 inches in diameter. The course 30 includes several water hazards 40, various sand traps 42, a clubhouse 44, and a driving range for practice purposes. A bridge 46 is provided on the ninth hole so that players may walk over the water hazard. The objective, as in the regulation game, is to complete the course in as few strokes as possible. The normal rules of golf apply to this game concerning penalty strokes, line of flight rulings, and balls hit into water hazards or out of bounds.

EXAMPLE 2

A typical example of a nine-hole short golf course 30 is one having the following data for the holes and for the course:

| HOLE | 1 | 2 | 3 | 4 | 5 | 6 | 7 | 8 | 9 | TOTAL |
|---|---|---|---|---|---|---|---|---|---|---|
| YARDS | 125 | 82 | 140 | 78 | 130 | 128 | 150 | 195 | 122 | 1150 |
| PAR | 4 | 3 | 5 | 3 | 4 | 4 | 4 | 5 | 4 | 36 |
| HANDICAP | 6 | 9 | 7 | 8 | 1 | 4 | 2 | 5 | 3 | |

Advantages Of The Short Course Golf Game

The short course game using the ball 10 incorporates everything that makes the regular game of golf fun and yet it eliminates various aspects which make the regular game of golf an experience which is too difficult, too tedious, or too time-consuming to enjoy. As a result, the short course game appeals to a much broader segment of the population than the regular game of golf. For many people, a regulation golf ball is just too small an object to hit. Also, for many people it takes too long to play a round of regular golf. Rather than consuming as much as four hours in completing eighteen holes of regular golf, a round on this short course can take less than half that amount of time. On a nine hole short play course it is possible for a party of four to tee off and finish putting out on the ninth hole in 45 minutes to 1 hour, depending on course congestion. Furthermore, a regulation golf ball hit on a line drive can be a dangerous and potentially lethal object. By contrast, the inventive golf ball 10 is large enough so that even someone who has never swung a golf club may readily make contact with and hit ball 10, and a ball hitting someone is not nearly as likely to cause injury. Because of the characteristics of the golf ball 10, it is virtually harmless in terms of being able to cause damage. Someone can be hit squarely in the head from a short range with golf ball 10 and yet suffer no ill effects. Golf ball 10 will not usually break windows.

Although a skill level can definitely be achieved in this short course game just as in the regular game of golf, because the ball 10 is larger and the holes are shorter distances, players of varying degrees of athletic ability can be reasonably proficient and enjoy themselves. Because of the larger size of ball 10 and the ease with which it can be hit, a family with a ten year old boy and a teen age daughter can go out and play with their parents and all have an enjoyable family outing. This is very seldom possible in the regular game of golf unless all four members are proficient at the regular game.

As will be apparent to those skilled in the art to which the invention is addressed, the present invention may be embodied in forms and in embodiments other than those specifically disclosed above, without departing from the spirit or essential characteristics of the invention. The particular embodiments of the invention, described above, are therefore to be considered in all respects as illustrative and not restrictive. The scope of the present invention is set forth in the appended claims rather than being limited to the example set forth in the foregoing description.

What is claimed is:

1. The combination of:

(a) a golf course, and (b) an oversize hollow inflated golf ball with which said golf course is played comprising:

(1) a durable spherical plastic ball having an inflated diameter of 3.0 to 4.0 inches, a wall thickness of 0.170 to 0.220 inch, a weight of 90 to 100 grams, and an air pressurization of 8 to 10 pounds per square inch;

(2) said ball having 8 to 10 dimples per square inch in its exterior surface, each of said dimples having a depth of 0.018 to 0.022 inch and a diameter of 0.250 to 0.310 inch;

(3) said ball wall being constructed of plasticized vinyl polymer or vinyl copolymer, said ball wall having a hardness of about Shore A 70 Durometer; and (4) said ball wall having an aperture for receiving air under pressure, said aperture being closed by a resilient plug inserted therein, whereby said air pressurization is maintained within said inflated ball.

2. The combination of claim 1 in combination with selected conventional regulation golf clubs with which, together with the oversize hollow inflated golf ball of claim 1, the course is played.

3. The combination of claim 1 wherein the holes of said course range from about 60 to about 195 yards in length.

4. An oversize hollow inflated golf ball for use in a game of golf, said golf ball comprising:

(a) a durable spherical plastic ball having an inflated diameter of 3.0 to 4.0 inches, a wall thickness of 0.170 to 0.220 inch, a weight of 90 to 100 grams, and an air pressurization of 8 to 10 pounds per square inch;

(b) said ball having 8 to 10 dimples per square inch in its exterior surface, each of said dimples having a depth of 0.018 to 0.022 inch and a diameter of 0.250 to 0.310 inch;

(c) said ball wall being constructed of plasticized vinyl polymer or vinyl copolymer, said ball wall having a hardness of about Shore A 70 Durometer; and (d) said ball wall having an aperture for receiving air under pressure, said aperture being closed by a resilient plug inserted therein, whereby said air pressurization is maintained within said inflated ball.

5. An oversize hollow inflated golf ball for use in a game of golf, said golf ball comprising:

(a) a durable spherical plastic ball having an inflated diameter of 3.25 inches, a wall thickness of 0.2 inch, a weight of 95 grams, and an air pressurization of 9 pounds per square inch;

(b) said ball having 9 dimples per square inch in its exterior surface, each of said dimples having a depth of 0.020 inch and a diameter of 0.280 inch;

(c) said ball wall being constructed of a vinyl polymer containing a plasticizer, and having a hardness of about Shore A 70 Durometer; and (d) said ball wall having an aperture for receiving air under pressure, said aperture being closed by a resilient plug inserted therein, whereby said air pressurization is maintained within said ball.

* * * * *